US009163640B2

(12) United States Patent
Chang et al.

(10) Patent No.: US 9,163,640 B2
(45) Date of Patent: Oct. 20, 2015

(54) FAN

(75) Inventors: Chih-Hsiang Chang, Taoyuan Hsien (TW); Ding-Wei Chiu, Taoyuan Hsien (TW); Shih-Chou Chen, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 727 days.

(21) Appl. No.: 13/472,977

(22) Filed: May 16, 2012

(65) Prior Publication Data

US 2012/0301277 A1 Nov. 29, 2012

(30) Foreign Application Priority Data

May 26, 2011 (TW) ..... 100209444 U

(51) Int. Cl.

| | |
|---|---|
| ***F04D 29/66*** | (2006.01) |
| ***F04D 29/28*** | (2006.01) |
| ***F04D 25/06*** | (2006.01) |
| ***F04D 29/30*** | (2006.01) |

(52) U.S. Cl.
CPC ..... *F04D 29/281* (2013.01); *F04D 25/0613* (2013.01); *F04D 29/30* (2013.01)

(58) Field of Classification Search
CPC .... F04D 25/0613; F04D 29/281; F04D 29/30
See application file for complete search history.

(56) References Cited

U.S. PATENT DOCUMENTS

| | | | | |
|---|---|---|---|---|
| 3,531,221 | A * | 9/1970 | Engelbert et al. | 415/143 |
| 3,680,977 | A * | 8/1972 | Rabouyt et al. | 415/173.6 |
| 5,075,606 | A * | 12/1991 | Lipman | 417/423.7 |
| 6,194,798 | B1 * | 2/2001 | Lopatinsky | 417/356 |
| 7,083,387 | B2 * | 8/2006 | Chen et al. | 416/195 |

* cited by examiner

*Primary Examiner* — Igor Kershteyn
(74) *Attorney, Agent, or Firm* — Muncy, Geissler, Olds & Lowe, P.C.

(57) ABSTRACT

A fan includes a housing, an impeller and at least one position-limiting mechanism. The housing has an accommodating space for receiving the impeller. The impeller has a hub and a plurality of blades surrounding the hub. The position-limiting mechanism is located between the top of the blade and the inner side of the housing, and disposed on the top of the blade or the inner side of the housing.

9 Claims, 7 Drawing Sheets

FAN

CROSS REFERENCE TO RELATED APPLICATIONS

This Non-provisional application claims priority under 35 U.S.C. §119(a) on Patent Application No(s). 100209444 filed in Taiwan, Republic of China on May 26, 2011, the entire contents of which are hereby incorporated by reference.

BACKGROUND OF THE INVENTION

1. Field of Invention

The present invention relates to a fan and, in particular, to a fan with the function of preventing the blade loosing.

2. Related Art

The flat electronic computing device such as the notebook computer or tablet computer is usually configured with the build-in powerful high-speed processor. The operating processor may generate heat, which should be removed by proper heat-dissipating component (e.g. a fan) for maintaining the stable operation of the computing device.

Regarding to a notebook computer, in order to achieve the purpose of more compact size and portability, it usually adopts a centrifugal fan for heat dissipation. However, the shaft of the fan may tilt or loose due to collision or the heat-dissipation design during the carrying or putting down of the notebook computer. For solving this issue, as shown in FIG. 1, a fan 1 includes a housing 11, an impeller 12, a fasten ring 13, and a stator 14. The impeller 12 and the stator 14 are disposed in the housing 11. The impeller has a hub 121, a plurality of blades 122 disposed on the periphery of the hub 121, and a shaft 123 matched with the bearing 141 of the stator 14. The fasten ring 13 is disposed in a recess 1231 of the shaft 123 and attached to the bearing 141. The function of the fasten ring 13 is to limit the shaft 123 so as to prevent the impeller 12 from loosing during the rotation.

However, the above-mentioned configuration for limiting the impeller 12 must prepare the sufficient space for configuring the fasten ring 13. In other words, for configuring the fasten ring 13, the length of the shaft 123 must be long enough or the length of the bearing 141 must be reduced. If the length of the shaft 123 is long enough for configuring the fasten ring 13, the product may not be properly minimized. If the length of the bearing 141 is reduced, the duration of the fan 1 may decrease. In addition, the additional fasten ring 13 can increase the total manufacturing cost.

Therefore, it is an important subject of the present invention to provide a fan that can reduce the length of the shaft without affecting the fan property and structural strength and thus make the fan thinner.

SUMMARY OF THE INVENTION

In view of the foregoing subject, an objective of the present invention is to provide a fan that can reduce the length of the shaft and prevent the blades from loosing.

To achieve the above objective, the present invention discloses a fan including a housing, an impeller and at least one position-limiting mechanism. The housing has an accommodating space. The impeller is disposed in the accommodating space and has a hub and a plurality of blades surrounding the hub. The position-limiting mechanism is located between the top of the blade and the inner side of the housing, and disposed on the top of the blade or the inner side of the housing.

As mentioned above, in the fan of the present invention, the position-limiting mechanism is located between the top of the blade and the inner side of the housing, and disposed on the top of the blade or the inner side of the housing. Accordingly, when the fan rotates, the position-limiting mechanism can inhibit the impeller to move outwardly, and can properly keep the blades to rotate on the track of the normal operation by point-contact collision.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 2A:
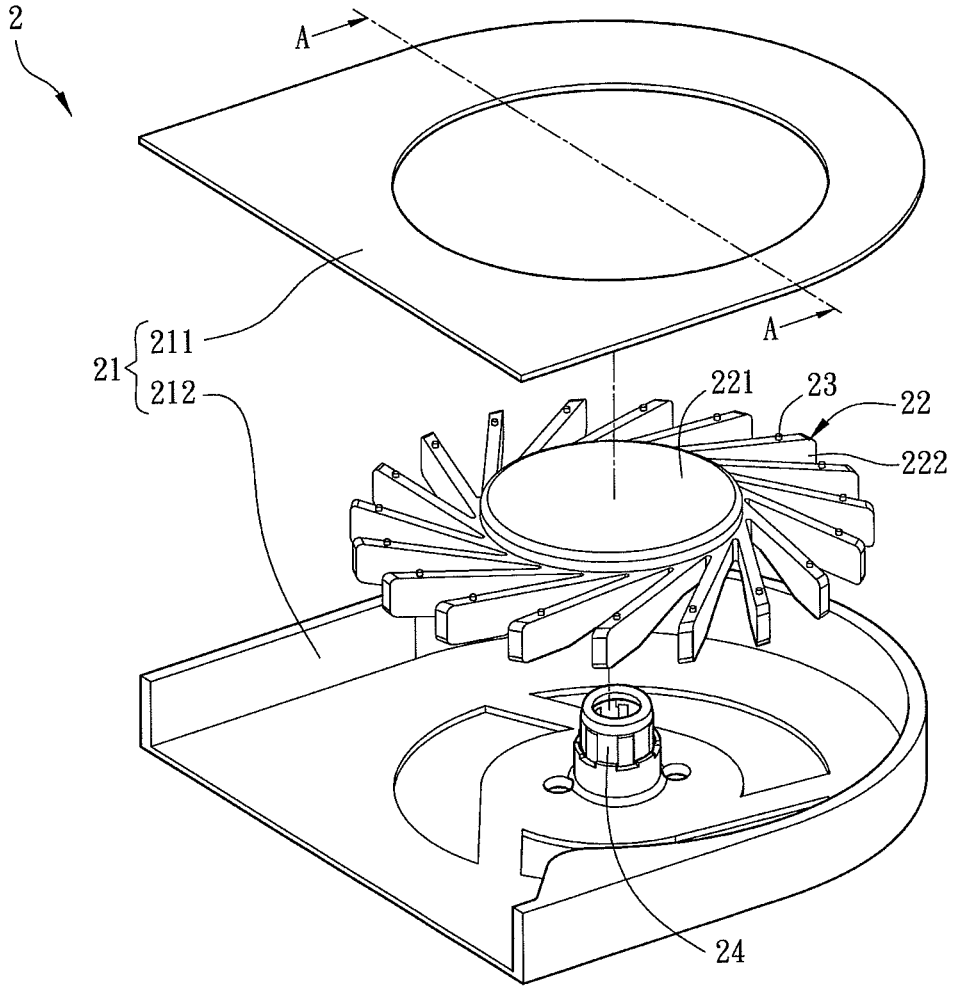
FIG. 2A is an exploded view of the fan according to a preferred embodiment of the present invention.
Figure 2B:
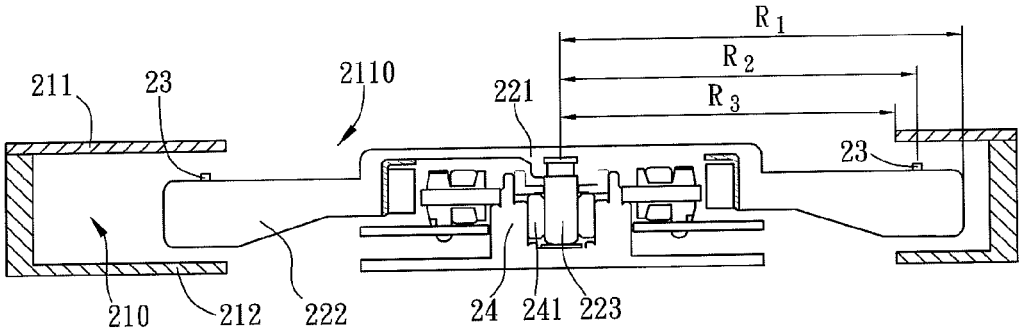
FIG. 2B is a cross-section view along the line AA of FIG. 2A.

FIG. 2A is an exploded view of a fan according to a preferred embodiment of the present invention, and FIG. 2B is a cross-section view along the line AA of FIG. 2A. Referring to FIGS. 2A and 2B, a fan 2 includes a housing 21, an impeller 22, at least one position-limiting mechanism 23, and a stator 24. The impeller 22 has a hub 221 and a plurality of blades 222 surrounding the hub 221. The housing 21 has an accommodating space 210, in which the impeller 22 and the stator 24 are disposed. The stator 24 is fixed on the housing 21. The shaft 223 of the impeller 22 and the bearing 241 of the stator 24 are matched with each other. The stator 24 can drive the impeller 22 to rotate, thereby rotating the blades 222. The position-limiting mechanism 23 is located between the top of the blade 222 and the inner side of the housing 21. In this embodiment, the position-limiting mechanism 23 is disposed on the top of the blade 222.

During the operation of the fan 2, when the impeller 22 tends to move outwards along the axis of the fan 2, the position-limiting mechanism 23 can inhibit the axial movement of the impeller 22, so that the position-limiting mechanism 23 can not loose out of the housing 21. In practice, when the position-limiting mechanism 23 collides with the housing 21, it can push the blades 222 back to the track of the normal operation. Accordingly, the impeller 22 can go back the desired position.

The position-limiting mechanism 23 is located between the opening 2110 of the housing 21 and the tail portion of the blade 222. As shown in FIG. 2B, R1 represents a distance from the tail portion of the blade 222 to the shaft 223, R2 represents a distance from the position-limiting mechanism 23 to the shaft 223 of the hub 221, and R3 represents a distance from the opening 2110 of the housing 21 to the shaft 223. Herein, the distance R2 is between the distances R1 and R3.

The position-limiting mechanism 23 and the blade 222 may be integrally formed as one piece, and the position-limiting mechanism 23 is preferably a protrusion, which protrudes from the top edge of the blade 222. The protrusion and the blade may be integrally formed as one piece. In this embodiment, the protrusion and the blade may be integrally formed as one piece by, for example but not limited to, injection molding. Alternatively, it is possible to form the blade 222 first and then to adhere the protrusion on the top edge of the blade 222.

The housing 21 includes an upper cover 211 and a lower cover 212, which combine to define the accommodating space 210. The position-limiting mechanism 23 is located between the top of the blade 222 and the inner side of the top cover 211. The top surface of the hub 221 is disposed facing to the opening 2110 of the top cover 211.

The stator 24 is fixed on the lower cover 212. When the impeller 22 rotates, it tends to move toward the upper cover 211. In order to prevent the impeller 22 to loosing from the stator 24, the position-limiting mechanism 23 is configured to restrict the impeller 22 to move along the axis of the fan 2, and to allow the blade 222 to go back the position of normal operation.

Figure 1:
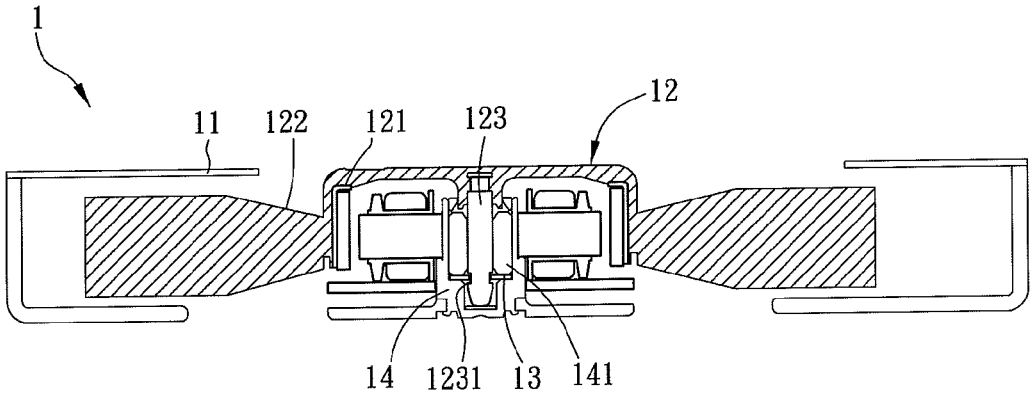
FIG. 1(Prior Art)
FIG. 1 is a schematic diagram showing a conventional fan.

Compared with those shown in FIG. 1, the recess disposed at the lower portion of the shaft 223 for matching with the additional fasten ring is not needed in this invention. Thus, the length of the shaft 223 of the impeller 22 can be properly reduced. This design also makes the thinner fan become possible. Moreover, the electronic apparatus, such as the notebook computer or tablet computer, configured with the fan 2 of the present invention can be thinner too.

Figure 2C:
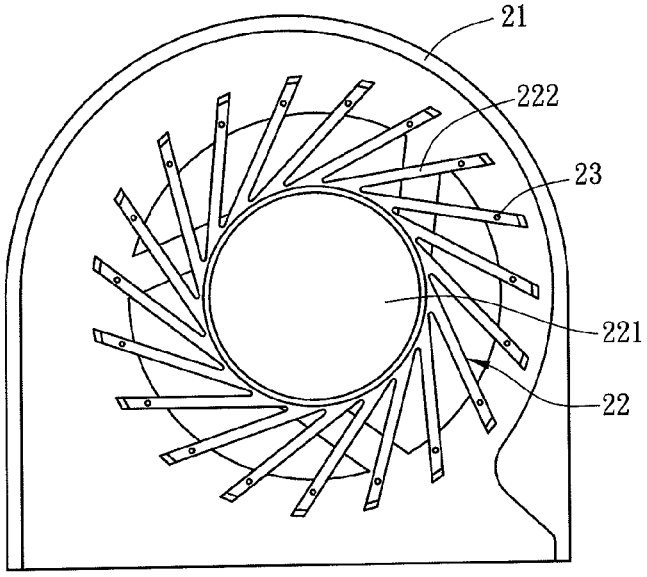
FIG. 2C is a top view of FIG. 2A.

FIG. 2C is a top view of FIG. 2A. Referring to FIGS. 2A and 2C, the fan 2 includes a plurality of position-limiting mechanisms 23. The distances from the position-limiting mechanisms 23 to the shaft 223 of the hub 22 are all the same. In this case, the position-limiting mechanisms 23 are arranged around the hub 22 and are all located on the same operation track.

Figure 3A:
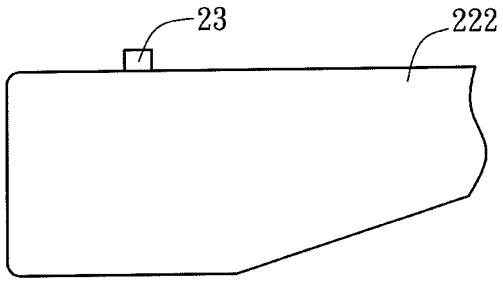
FIGS. 3A to 3C are schematic diagrams showing different aspects of the position-limiting mechanism according to the preferred embodiment of the present invention.
Figure 3B:
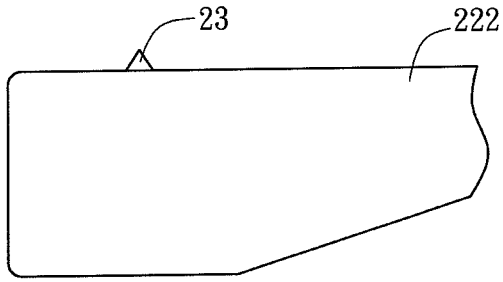
Figure 3C:
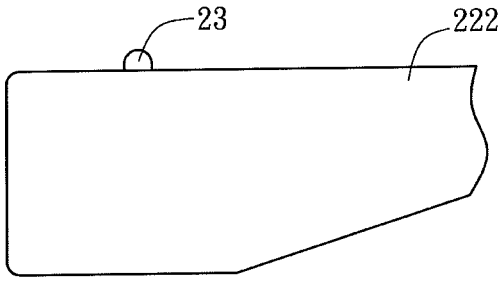

FIGS. 3A to 3C are schematic diagrams showing different aspects of the position-limiting mechanism according to the preferred embodiment of the present invention. With reference to FIGS. 3A to 3C, the position-limiting mechanism 23 is a protrusion with the shape of cylinder (see FIG. 3A), cone (see FIG. 3B), or hemisphere (see FIG. 3C).

FIGS. 4A to 6B are schematic diagrams of different aspects of the fan according to the preferred embodiment of the present invention. In the following aspects with reference to FIGS. 4A to 6B, the position-limiting mechanism 23 may be disposed on the top of the blade 222 or on the inner side of the housing 21.

Figure 4A:
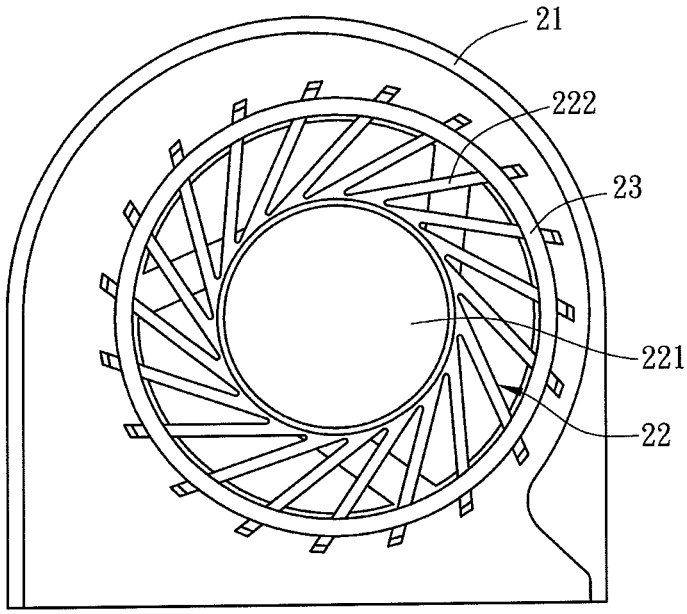
FIG. 4A is a top view of another aspect of the fan according to the preferred embodiment of the present invention.
Figure 4B:
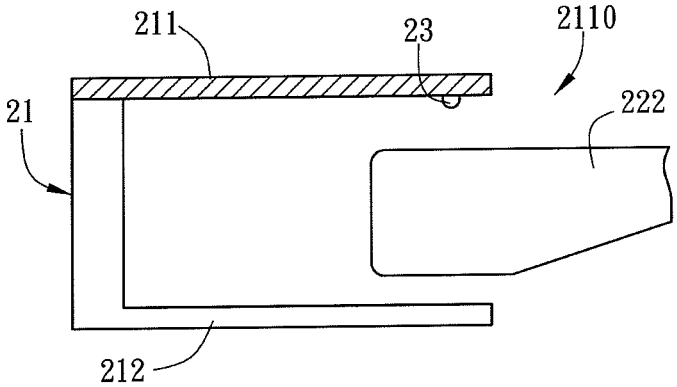
FIG. 4B is a cross-section view of a part of the fan shown in FIG. 4A.

FIG. 4A is a top view of another aspect of the fan 2, wherein most part of the upper cover 211 is omitted, and FIG. 4B is a lateral cross-section view of a part of the fan 2 shown in FIG. 4A. As shown in FIGS. 4A and 4B, the position-limiting mechanism 23 is a protrusion disposed on the inner side of the housing 21. The protrusion and the housing 21 may be integrally formed as one piece. In this embodiment, the protrusion and the upper cover 211 may be integrally formed as one piece by, for example but not limited to, injection molding. Alternatively, it is possible to form the upper cover 211 first and then to adhere the protrusion on the inner side of the upper cover 211. Besides, the protrusion of this aspect can also be cylinder, cone, or hemisphere as shown in FIGS. 3A to 3C.

As shown in FIGS. 5A to 6B, the position-limiting mechanism 23 may be disposed on the inner side of the housing. The position-limiting mechanism 23 and the housing are integrally formed as one piece. For example, the position-limiting mechanism 23 can be a protruding portion of the housing, which is protruded inwardly, or an end portion of the housing extending toward the blade.

Figure 5A:
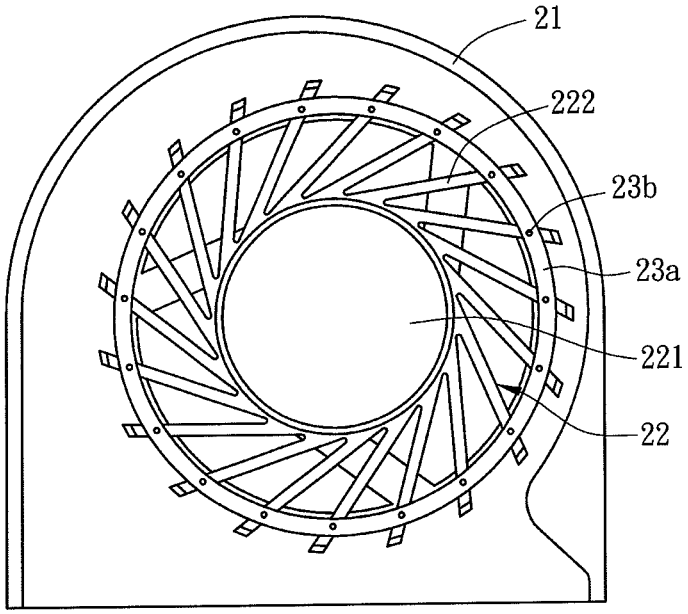
FIG. 5A is a top view of another aspect of the fan according to the preferred embodiment of the present invention.
Figure 5B:
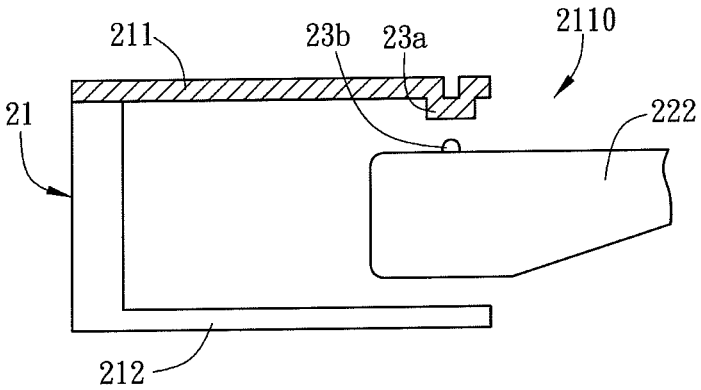
FIG. 5B is a cross-section view of a part of the fan shown in FIG. 5A.

FIG. 5A is a top view of another aspect of the fan 2, wherein most part of the upper cover 211 is omitted, and FIG. 5B is a lateral cross-section view of a part of the fan 2 shown in FIG. 5A. As shown in FIGS. 5A and 5B, the position-limiting mechanism 23*a* is disposed on the inner side of the upper cover 211. The position-limiting mechanism 23*a* and the upper cover 211 are integrally formed as one piece. In more detailed, the position-limiting mechanism 23*a* is a protruding portion of the upper cover 211, which is protruded inwardly. In this case, the position-limiting mechanism 23*a* can be a protruding portion of the upper cover 211 formed by punching the upper cover 211.

Figure 6A:
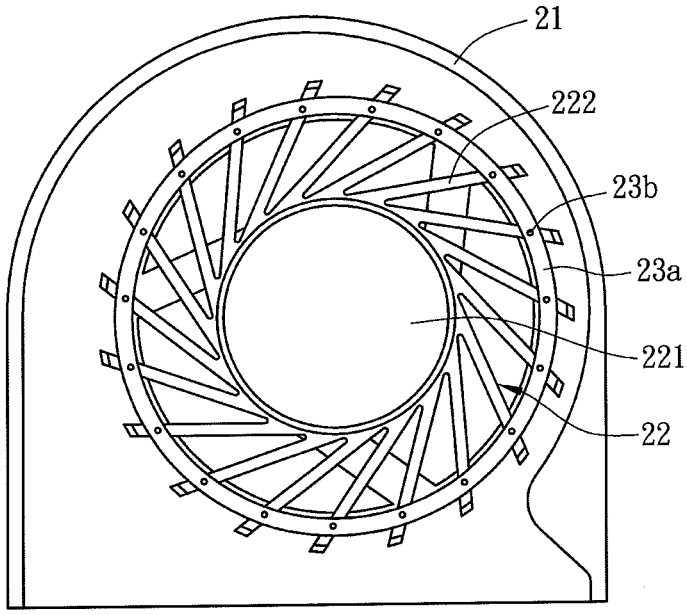
FIG. 6A is a top view of another aspect of the fan according to the preferred embodiment of the present invention.
Figure 6B:
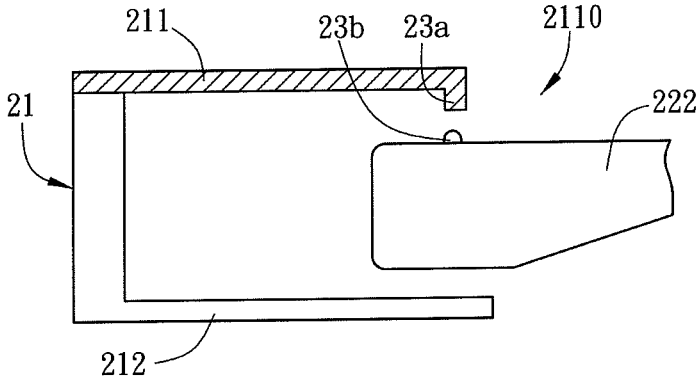
FIG. 6B is a cross-section view of a part of the fan shown in FIG. 6A.

FIG. 6A is a top view of another aspect of the fan 2, wherein most part of the upper cover 211 is omitted, and FIG. 6B is a lateral cross-section view of a part of the fan 2 shown in FIG. 6A. As shown in FIGS. 6A and 6B, the position-limiting mechanism 23*a* is disposed on the inner side of the upper cover 211. The position-limiting mechanism 23*a* and the upper cover 211 are integrally formed as one piece. In this case, the position-limiting mechanism 23*a* is an end portion of the upper cover 211 extending toward the blade 222.

In the aspects of FIGS. 5A to 6B, except for the position-limiting mechanism 23*a* disposed on the housing 21, another position-limiting mechanism 23*b* can also be disposed on the blade 222. The position-limiting mechanisms 23*a* and 23*b* are disposed corresponding to each other. For example, in the view from the opening 2110 of the upper cover 211 to the impeller 22, the position-limiting mechanisms 23*a* of the housing 21 are arranged in annular, and the position-limiting mechanisms 23*b* of the blades 222 are arranged within the annular area defined by the position-limiting mechanisms 23*a*. The operation track of the position-limiting mechanisms 23*b* of the blades 222 is similar to that of the position-limiting mechanisms 23*a* of the housing 21.

In the aspect of FIGS. 4A and 4B, the top edge of the blade 222 may be also configured with the additional position-limiting mechanism.

In all of the above embodiments, the position-limiting mechanism may include a magnetic material. Regarding to the fan of FIGS. 5A to 6B, the position-limiting mechanisms disposed on the housing 21 and the blade 222 are arranged to provide magnetic repulsion. For example, the position-limiting mechanism 23*b* of the blade 222 has an N pole towards the housing 21, and the position-limiting mechanism 23*a* of the housing 21 has an N pole towards the blade 222. Otherwise, the position-limiting mechanism 23*b* of the blade 222 has an S pole towards the housing 21, and the position-limiting mechanism 23*a* of the housing 21 has an S pole towards the blade 222.

In the above embodiments, the position-limiting mechanism can collide to the housing or blade by point contact, so that the blades can be properly kept to rotate on the track of the normal operation. This design of the present invention would not affect the performance and structural strength of the fan, thereby remaining the durability and reliability of the fan. In addition, the length of the shaft of the fan can be reduced, so that the entire fan can be thinner. Moreover, the electronic apparatus, such as the notebook computer or tablet computer, configured with the fan 2 of the present invention can be thinner too.

In the fan of the present invention, the position-limiting mechanism is located between the top of the blade and the inner side of the housing, and disposed on the top of the blade or the inner side of the housing. Accordingly, when the fan rotates, the position-limiting mechanism can inhibit the impeller to move outwardly, and can properly keep the blades to rotate on the track of the normal operation by point-contact collision.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan, comprising:

a housing having an accommodating space;

an impeller disposed in the accommodating space and having a hub and a plurality of blades surrounding the hub; and at least one position-limiting mechanism located between the top of the blade and the inner side of the housing, and disposed on the top of the blade or the inner side of the housing, wherein the distance from the position-limiting mechanism to a shaft of the hub is between a distance from the outermost end of the tail portion of the blade to the shaft and a distance from the opening of the housing to the shaft.

2. The fan according to claim 1, wherein the position-limiting mechanism and the housing are integrally formed as one piece, and the position-limiting mechanism is a protruding portion of the housing or an end portion of the housing extending toward the blade.

3. The fan according to claim 1, wherein the position-limiting mechanism is an annular protrusion disposed on the inner side of the housing.

4. The fan according to claim 1, wherein the position-limiting mechanism and the blade are integrally formed as one piece, and the position-limiting mechanism is a protrusion from the top edges of the blades.

5. The fan according to claim 1, wherein the housing has an upper cover and a lower cover, the upper cover and the lower cover combine to define the accommodating space, and the position-limiting mechanism is located between the top of the blade and the inner side of the top cover.

6. The fan according to claim 5, further comprising:

a motor comprising a rotor and a stator, wherein the stator is fixed on the lower cover and the impeller is fixed to the rotor.

7. The fan according to claim 5, wherein the upper cover has an opening, and a top surface of the hub is disposed facing to the opening.

8. The fan according to claim 1, wherein the position-limiting mechanism comprises a magnetic material.

9. The fan according to claim 1, wherein the fan comprises a plurality of position-limiting mechanisms, and the distances from the position-limiting mechanisms to a shaft of the hub are all the same.

* * * * *